US007042982B2

(12) United States Patent
Pau et al.

(10) Patent No.: US 7,042,982 B2
(45) Date of Patent: May 9, 2006

(54) FOCUSABLE AND STEERABLE MICRO-MINIATURE X-RAY APPARATUS

(75) Inventors: Stanley Pau, Hoboken, NJ (US); Donald Milan Tennant, Gillette, NJ (US)

(73) Assignee: Lucent Technologies Inc., Murray Hill, NJ (US)

( * ) Notice: Subject to any disclaimer, the term of this patent is extended or adjusted under 35 U.S.C. 154(b) by 51 days.

(21) Appl. No.: 10/716,697

(22) Filed: Nov. 19, 2003

(65) Prior Publication Data

US 2005/0105690 A1 May 19, 2005

(51) Int. Cl.

| | |
|---|---|
| ***G21K 1/00*** | (2006.01) |
| ***G21K 1/02*** | (2006.01) |
| ***H01J 3/14*** | (2006.01) |
| ***H01J 35/14*** | (2006.01) |

(52) U.S. Cl. ..... 378/145; 378/122; 378/147; 250/396 R

(58) Field of Classification Search ..... 378/65, 378/151, 84, 85, 122; 600/160, 20; 250/399, 250/400, 396 ML, 396 R, 398
See application file for complete search history.

(56) References Cited

U.S. PATENT DOCUMENTS

| | | | | |
|---|---|---|---|---|
| 3,882,314 | A * | 5/1975 | Benedetti et al. | 378/65 |
| 4,340,283 | A | 7/1982 | Cohen | 351/161 |
| 4,860,329 | A * | 8/1989 | Weiser et al. | 378/50 |
| 5,170,422 | A * | 12/1992 | Fiebiger | 378/136 |
| 5,628,659 | A | 5/1997 | Xie et al. | 445/3 |
| 6,148,061 | A | 11/2000 | Shefer et al. | 378/121 |
| 6,259,764 | B1 | 7/2001 | Evans-Lutterodt et al. | 378/84 |
| 6,259,765 | B1 * | 7/2001 | Baptist | 378/136 |
| 6,333,968 | B1 * | 12/2001 | Whitlock et al. | 378/136 |
| 6,448,100 | B1 | 9/2002 | Schulte et al. | 438/20 |
| 6,477,233 | B1 | 11/2002 | Ribbing et al. | 378/136 |
| 6,592,526 | B1 | 7/2003 | Lenker | 600/463 |

(Continued)

OTHER PUBLICATIONS

Henke et al., *Two-channel, elliptical* . . . , Rev. Sci. Instrum., vol. 56, No. 8, p. 1537 (Aug. 1985).

(Continued)

*Primary Examiner*—Craig E. Church
*Assistant Examiner*—Krystyna Suchecki

(57) ABSTRACT

A micro-miniature x-ray apparatus comprises: a first chip subassembly including a source of x-rays including both Bremsstrahlung photons and characteristic x-rays; a second chip subassembly including a filter for transmitting the characteristic x-rays and blocking the Bremsstrahlung photons; a third chip subassembly including a movable element for focusing or collimating the transmitted characteristic x-rays into a beam and means for controlling the position of the focusing element. In one embodiment, the controlling means include a micro-electromechanical system (MEMS). In another embodiment, the position of the movable element determines how the x-ray beam is steered to the focal area. In still another embodiment, the x-ray source includes a field emitter electron source and a target responsive to the electrons for generating x-rays. In this case, the x-ray beam is also steered by selectively energizing the anode segments. In yet another embodiment, the movable element includes a Fresnel zone plate; in still another embodiment it includes an array of poly-capillaries. Advantageously, our x-ray source, including its focusing, collimating and steering components, can be fabricated small enough to be mounted at the end of a catheter. In addition, in some embodiments it can also fabricated sufficiently inexpensively to be disposable after each use.

13 Claims, 5 Drawing Sheets

U.S. PATENT DOCUMENTS

| | | | | |
|---|---|---|---|---|
| 6,809,465 | B1 * | 10/2004 | Jin | 378/122 |
| 2002/0003856 | A1 * | 1/2002 | Gutman | 378/65 |
| 2003/0085360 | A1 * | 5/2003 | Parker et al. | 250/396 R |
| 2003/0149327 | A1 * | 8/2003 | Chin et al. | 600/1 |

OTHER PUBLICATIONS

Lee et al., *High aspect ratio* . . . , J. Vac. Sci. Tech., vol. B12, No. 6, p. 3425 (Nov./Dec. 1994).

Tang et al., *Emission measurements* . . . , J. Vac. Sci. Tech., vol. B14, No. 6, p. 3455 (Nov./Dec. 1996).

Nagao et al., *Metal-oxide-semiconductor* . . . , J. Vac. Sci. Tech., vol. B21, No. 1, p. 495 (Jan./Feb. 2003).

Busta et al., *Characterization of electron* . . . , J. Vac. Tech., vol. B21, No. 1, p. 344 (Jan./Feb. 2003).

Evans-Lutterodt et al., *Single-element* . . . , Optics Express, vol. 11, No. 8, p. 919 (Apr. 2003).

* cited by examiner

FOCUSABLE AND STEERABLE MICRO-MINIATURE X-RAY APPARATUS

BACKGROUND OF THE INVENTION

1. Field of the Invention

This invention relates micro-miniature x-ray apparatus in general and, more particularly, to such apparatuses in which the direction of an x-ray beam can be focused and steered.

2. Discussion of the Related Art

Several workers in the medical equipment field have proposed miniature x-ray sources for the treatment of maladies such as cancer tumors and coronary artery disease. In general, the source is inserted into body vessels or other body cavities in order to reach and irradiate the diseased area. In one approach, a catheter with a miniature x-ray source is contemplated for irradiation of cardiovascular tissue. For the treatment of a stenosed artery such a catheter has been proposed for use in conjunction with Percutaneous Transluminal Coronary Angeoplasty (PCTA). See, for example, C. Ribbing et al., U.S. Pat. No. 6,477,233 issued on Nov. 5, 2002 and R. Shefer et al., U.S. Pat. No. 6,148,061 issued on Nov. 14, 2000, both of which are incorporated herein by reference.

Both of these patents, however, describe x-ray sources that emit x-rays isotropically. The output of the sources is not focused and is not steered, which is undesirable to the extent that healthy tissue in the vicinity of the diseased area is irradiated with x-rays.

Thus, a need remains in the art for a miniature x-ray source whose output can be focused and steered.

A need also remains for a miniature x-ray source that can be implemented using a multiplicity of wafer or chip assemblies.

BRIEF SUMMARY OF THE INVENTION

In accordance with one aspect of our invention, a micro-miniature x-ray apparatus comprises: a first chip subassembly including a radiation source for generating both Bremsstrahlung photons and characteristic x-rays; a second chip subassembly including a filter for preferentially transmitting the characteristic x-rays and blocking the Bremsstrahlung photons; and a third chip subassembly including a movable element for focusing or collimating the transmitted characteristic x-rays into a beam and means for controlling the position of the movable element.

In one embodiment, the controlling means includes a micro-electromechanical system (MEMS) structure.

In another embodiment the position of the focusing element determines how the x-ray beam is steered to the focal area.

In still another embodiment, the x-ray source comprises a field emitter electron source, including a segmented anode, and a target responsive to the electrons for generating x-rays. In this case, the x-ray beam is also steered by selectively energizing the anode segments.

In yet another embodiment, the movable element includes a Fresnel device (e.g., a zone plate or lens); in still another embodiment it includes an array of poly-capillaries.

Advantageously, our x-ray source, including its focusing, collimating and steering components, can be fabricated small enough to be mounted at the end of a catheter. In addition, in some embodiments it can also fabricated sufficiently inexpensively to be disposable after each use.

BRIEF DESCRIPTION OF THE SEVERAL VIEWS OF THE DRAWING

Our invention, together with its various features and advantages, can be readily understood from the following more detailed description taken in conjunction with the accompanying drawing, in which.

DETAILED DESCRIPTION OF THE INVENTION

General Structure

Figure 1:
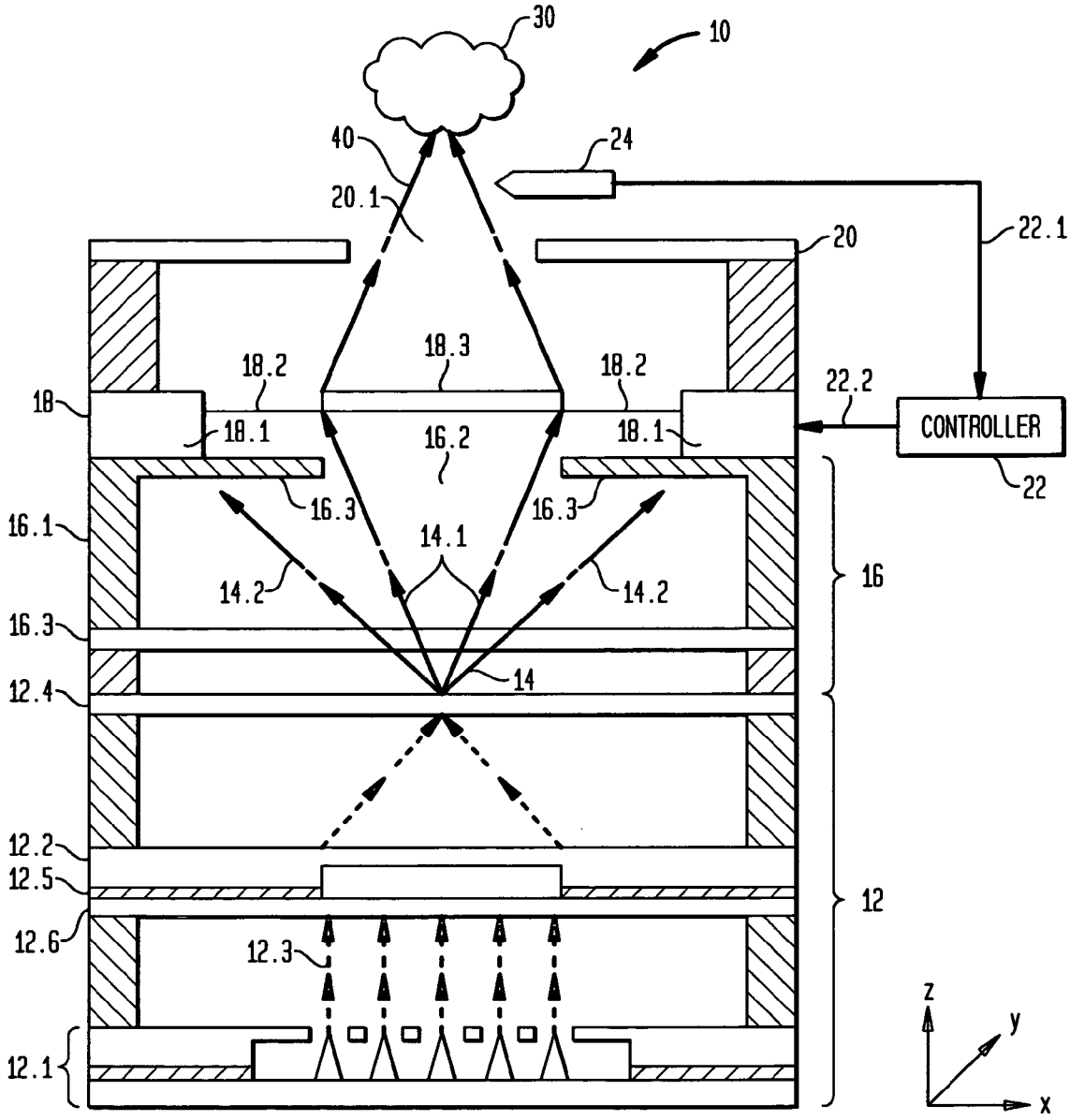
FIG. 1 is a schematic, cross sectional view of a micro-miniature x-ray apparatus in accordance with one embodiment of our invention.

With reference now to FIG. 1, we show a schematic cross-sectional view of an x-ray apparatus 10 in accordance with one embodiment of our invention. The apparatus 10 is designed to generate an x-ray beam 40 that irradiates a particular diseased tissue region 30 (e.g., a cancerous tumor or plaque on the interior walls of coronary arteries). Illustratively, the x-ray beam 40 is focused to a spot size of less than 100 nm, whereas the dimension of tissue region 30 may be less than 2 mm.

Apparatus 10 is typically contained within a vacuum chamber (not shown), which is illustratively maintained at a vacuum of about $10^{-4}$–$10^{-6}$ torr by means well known in the art. Moreover, the complete assembly, including the apparatus 10 and the vacuum chamber, is typically mounted on a catheter in order to insert the source into a body vessel or other cavity and thereby convey the apparatus to a point that is proximate diseased tissue region 30.

Illustratively, the apparatus 10 comprises a first chip subassembly that includes a source 12 of unfiltered x-rays, which include both characteristic x-rays 14.1 and Bremsstrahlung photons 14.2. A second chip subassembly includes a filter 16 that preferentially transmits the characteristic x-rays 14.1 and blocks the Bremsstrahlung photons from reaching the region 30. The transmitted characteristic x-rays are focused or collimated, and steered by means of a third chip subassembly that includes a movable element 18.3 and a MEMS structure 18. A controller 22 applies suitable voltage signals to the MEMS structure 18, which in turn controls the position of movable element 18.3, thereby generating x-ray beam 40 that can be readily directed to and collimated or focused on the desired region 30 of diseased tissue without significantly also irradiating nearby healthy tissue.

By the term position we mean the location of the movable element 18.2 along rectangular x-y-z coordinates as well its orientation or tilt relative to those axes.

The apparatus 10 may be operated without feedback, relying instead for accuracy solely on being designed to satisfy predetermined specifications (i.e., the apparatus may be pre-calibrated), or it may be operated with feedback so that its operating conditions are dynamically calibrated. In the latter case, a sensor 24 detects an operating parameter of the x-ray beam 40 (e.g., its intensity or potion) or of apparatus 10 (e.g., its temperature) and generates a corresponding signal on lead 22.1, which is provided as an input to controller 22. The latter compares the signal on lead 22.1 to a reference level and generates a control signal on lead 22.2. The latter is provided as an input to MEMS structure 18, which, if necessary, alters the position of movable element 18.3.

The Filter 16

Figure 14:
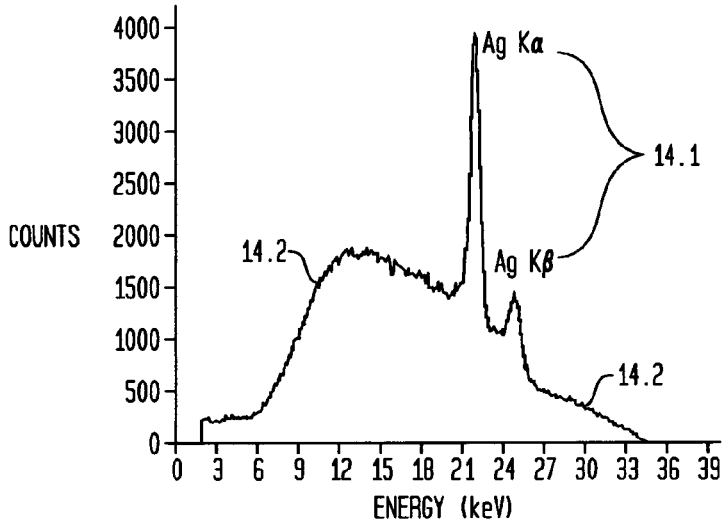
FIG. 14 is a graph of the x-ray spectrum of a Ag target irradiated with electrons at a cathode-to-anode voltage of 35 kV.
Figure 15:
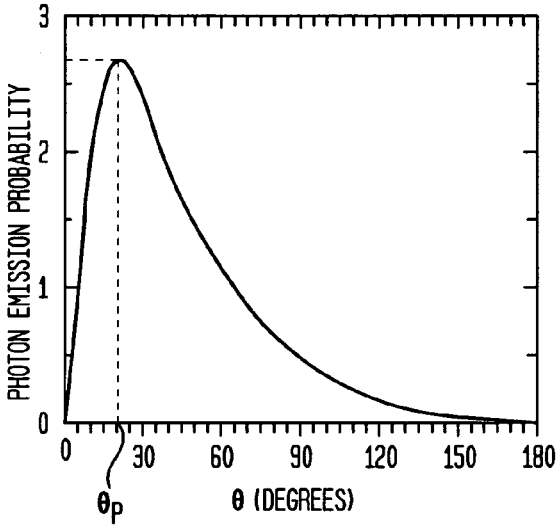
FIG. 15 is a graph showing the calculated angular distribution for emission of 10 keV Bremsstrahlung photons by 100 keV electrons striking an Al target.
Figure 16:
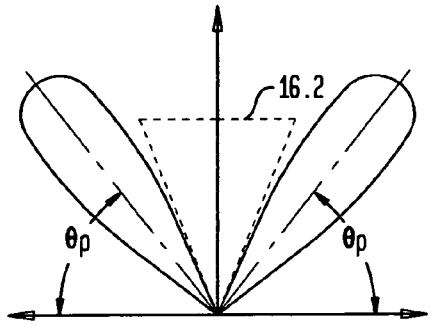
FIG. 16 is a schematic drawing showing how the spatial distribution of Bremsstrahlung photons allows them to be filtered out by use of an aperture 16.2.

The operation of filter 16 is best understood by reference to FIGS. 14–16. The spectrum of unfiltered x-rays 14 generated by x-ray source 12 is illustrated in FIG. 14. The characteristic x-rays 14.1 are relatively narrow band lines, whereas the Bremsstrahlung photons 14.2 are broadband. Two characteristic x-rays lines with narrow energy spectra (the peaks denoted as $AgK_\alpha$ and $AgK_\beta$) are shown for purposes of illustration only. Since Bremsstrahlung photons cannot be readily focused (because their broad energy spectrum would require multiple wavelength-dependent lenses to focus each narrow portion of the spectrum), it is desirable to block them from reaching the tissue region 30. To do so, we rely on the fact that characteristic x-rays are isotropic, whereas as Bremsstrahlung photons have an angular dependence. The latter is depicted in FIGS. 15–16, which show that Bremsstrahlung photons illustratively have their peak intensity at an angle $\theta_p$~22°. Consequently, a spatial filter 16.1 (FIG. 1) with an aperture 16.2 (FIGS. 1 & 2) can be used to prevent most of the Bremsstrahlung photons from reaching tissue region 30. An exemplary aperture 16.2 that has a half opening angle less than 22° at target 12.4 will block a substantial portion of the Bremsstrahlung photons.

Further filtering of Bremsstrahlung photons can be realized by means of optional spectral filter 16.3, which may be a layer of Ni, Si, Cu, Saran, or any of the other materials listed in Henke et al., *Rev. Sci. Instrum.*, Vol. 56, p. 1537 (1985), which is incorporated herein by reference. The particular material utilized depends on the frequency (energy) of the Bremsstrahlung photons to be filtered out. Preferably, the spatial and spectral filters are used together to enhance the filtering effectiveness.

Both the spatial and spectral filters, of course, transmit a significant fraction of the characteristic x-rays to the tissue region 30.

The Unfiltered X-ray Source 12

Figure 13:
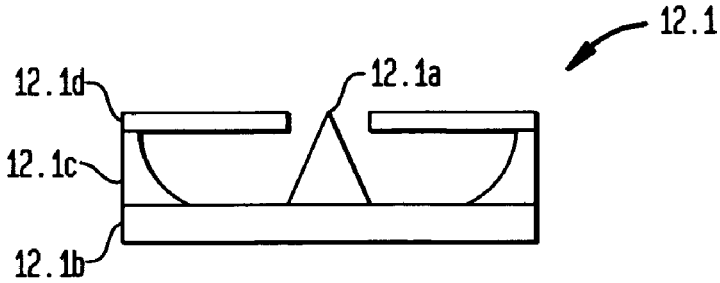
FIG. 13 is a schematic, cross-sectional view of an illustrative embodiment of a single field emitter of the type useful for generating electrons, and in conjunction with a suitable target, for generating x-rays in the apparatus of FIG. 1, in accordance with another embodiment of our invention.

In one embodiment, the unfiltered x-ray source 12, as shown in FIGS. 1 & 13, comprises an array of field emitters 12.1 that generate an electron beam (e-beam) 12.3 via the well-known phenomenon of cold cathode emission. The e-beam in turn is accelerated via anode 12.6, focused by electron lens 12.2, and then made incident upon a target 12.4, which absorbs the electrons and generates unfiltered x-rays 14; that is, the electrons in e-beam 12.3 eject inner shell (core) electrons in the target material. The relaxation of outer shell electrons to empty inner shell states results in the emission of x-rays 14.

The electron lens 12.2, which is separated from anode 12.6 by electrically insulating layer 12.5, is illustratively an Einzel lens of the type described by Lee et al., *J. Vac. Sci. Tech.*, Vol. 12, No. 6, pp. 3425–3430 (1994), which is incorporated herein by reference.

Each field emitter 12.1, as shown in FIG. 13, includes an emitter cone 12.1*a* formed on an insulating substrate 12.1*b* that is either grounded or maintained at a high voltage. Illustratively, the emitter cone comprises a material such as a tungsten wire, nanocrystalline carbon, or a silicon tip. In addition, an apertured gate electrode 12.1*d* is supported by an insulating layer 12.*c* and positioned so that its aperture is centered around and adjacent the tip of the emitter cone. As shown in FIG. 1, for an array of emitters the gate electrode may take the form of a grid.

Illustratively, the emitter cone density in the array is about $10^6/cm^2$, with the actual density depending on the desired electron fluence. (In some embodiments, a single emitter cone could be used rather than an array.) Typically the emitter cones have a periodicity of about 200 nm, and their tip radii are less than about 10 nm. The gate apertures have a diameter of about 70 nm. Illustratively, the substrate comprises quartz, the insulating layer comprises an oxide, and the target comprises tungsten. In operation, the anode-to-cathode voltage is of the order of 100 kV to generate high-energy electrons suitable for x-ray generation, and a bias voltage of about 50–100 V is applied between the gate electrode and each tip pair, which generates about 1 μA of electron current per tip. In general, however, the bias voltage is chosen to give a desired field strength, which is typically about $10^5$–$10^7$ V/m.

Those skilled in the art will readily appreciate that driving the gate electrode with a combination of DC voltages and AC pulses of different amplitude can optimize the current and lifetime of the emitter tips.

For more detail on field emitter designs, see Tang et al., *J. Vac. Sci. Tech.*, Vol. B14, p. 3455 (1996), Schulte et al., U.S. Pat. No. 6,448,100 issued on Sep. 10, 2002, and Xie et al., U.S. Pat. No. 5,628,659 issued on May 13, 1997, all of which are incorporated herein by reference. For detail on how such field emitters can be integrated with MOSFETs, see Nagao et al., *J. Vac. Sci. Tech.*, Vol. B21, p. 495 (2003), which is incorporated herein by reference.

Figure 2:
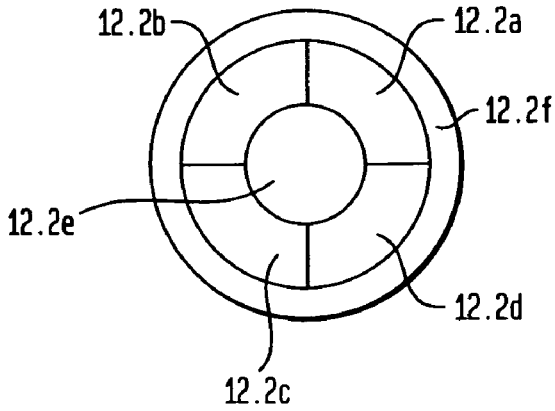
FIG. 2 is a schematic, top view of an illustrative embodiment of a MEMS controller for controlling the position of the movable focusing or collimating element of the apparatus of FIG. 1.

In another embodiment, the acceleration electrode may be designed to perform a coarse steering function. More specifically, as shown in FIG. 2, the acceleration electrode is segmented into a multiplicity of sections 12.2*a*, 12.2*b*, 12.2*c* and 12.2*d* (four sections are depicted for purposes of illustration only; less than or more than four are within the scope of our invention). The four electrode sections are positioned between a circular central aperture 12.2*e* and an annular support member 12.2*f*. By controlling to which of the electrode sections voltage is applied, we can shift the actual location from which the e-beam 12.3 emanates, which in turn shifts the actual position of the output x-ray beam 40. This segmented electrode field emitter may be used separately to provide coarse steering of the output beam 40, or in it may be used in conjunction with the MEMS steering structure 18 (described below) to also provide fine steering of the output beam 40.

The MEMS Steering Structure 18

Figure 3:
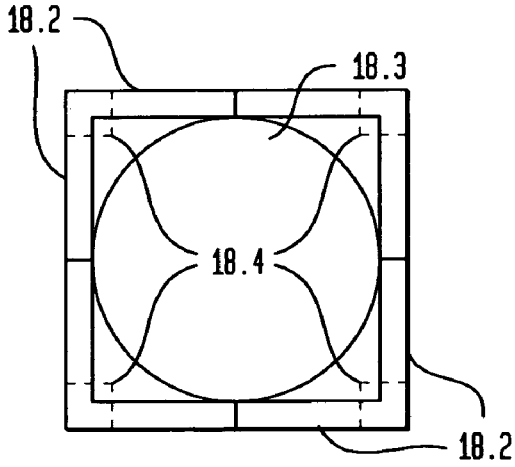
FIG. 3 is a schematic, top view of an illustrative embodiment of an e-beam controller of the apparatus of FIG. 1.

The MEMS structure 18 includes a support structure 18.1, resilient means 18.2, a movable top element 18.3 (e.g., a microlens or collimator), which also functions as a top electrode, and a single bottom electrode or a multiplicity of bottom electrodes 18.4, as shown in FIGS. 1 & 3. The support structure has an opening in which the movable element is suspended by means of the resilient means 18.2. Illustratively, the resilient means are serpentine springs (not shown). Finally, the entire movable element 18.3 serves as the top electrode, whereas the bottom electrodes 18.4 are positioned around the perimeter of a base (e.g., on the top of the annular portion 16.3 of spatial filter 16.1). The configuration of a similar MEMS structure is described in greater detail in copending application Ser. No. 10/391,330, which was filed on Mar. 18, 2003 and is entitled Adjustable Compound Microlens Apparatus with MEMS Controller (Kornblit-Pau-Simon 16-8-1). This application, which is assigned to the assignee hereof, is incorporated herein by reference. Although the Kornblit et al. application describes the design and operation of MEMS-adjustable compound microlens structures, the portion of that application that relates to the movable microlens is particularly applicable to our invention.

Illustratively, the movable top electrode (x-ray microlens) is coupled to an electrical source of ground potential, and the bottom electrodes 18.4 are coupled to a source of voltage. Each bottom electrode 18.4 may have the same or a different voltage applied to it. The position (vertical, horizontal and/or tilt) of the movable top element 18.3 may be adjusted (i.e., tuned) by varying the voltages applied to all or any subcombination of the multiplicity of bottom electrodes 18.4. By altering the position of the top movable element 18.3 we are able to steer the output x-ray beam 40, to alter the location of its focal point, and/or to collimate it.

In general, the voltages applied via the MEMS structure 18 alter the capacitive coupling between the movable top element 18.3 and the base, thereby causing the movable element 18.3 to move. For example, when voltages are applied between the multiplicity of bottom electrodes 18.4 and the top electrode (movable element 18.3) of FIG. 3, the movable element 18.3 is pulled toward the base. The serpentine springs 18.2 that support the movable element 18.3 provide a restoring force and can be designed to allow large variations in the vertical separation between the movable element 18.3 and the base. By increasing the length and number of repetitions of the springs, a small spring constant and a large displacement (the amount by which the vertical separation changes in response to an applied voltage) are attained.

Alternatively, the movable top electrode 18.3 (x-ray lens) is coupled to a source of voltage and all the bottom electrodes 18.4 are coupled to an electrical source of ground potential. In this embodiment, the vertical separation between the movable top element 18.3 and the base can be adjusted, but not the relative position or tilt.

X-ray Microlens 18.3

Figure 8:
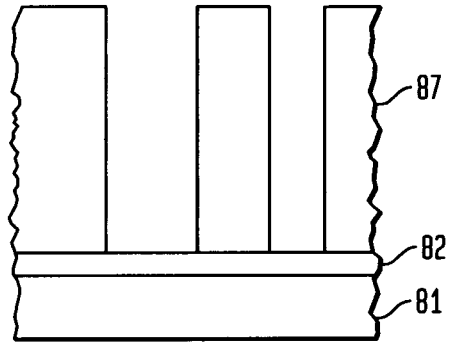
FIGS. 8–10 are schematic views depicting another sequence of processing steps for fabricating a zone plate of the type shown in FIG. 4, in accordance with another embodiment of our invention.
Figure 9:
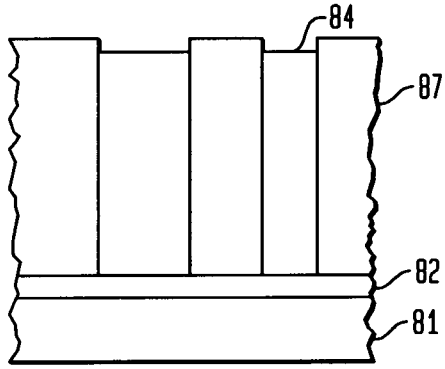
Figure 10:
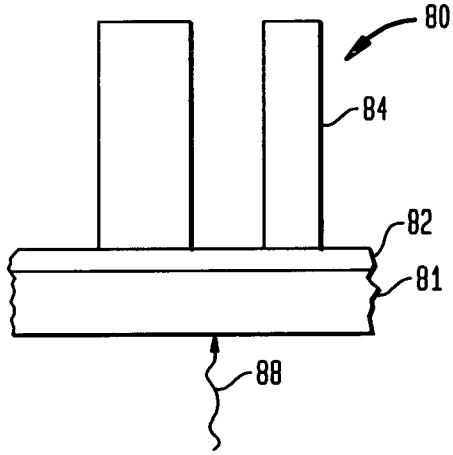

The movable element 18.3 (FIG. 1) may comprise, for example, an x-ray microlens (e.g., a well-known Fresnel device, such as a Fresnel zone plate, as shown in FIGS. 4–8, or a Fresnel lens, as described, for example, by Evans-Lutterodt et al., *Optics Express*, Vol. 11, No. 8, pp. 919–926 (2003), which is incorporated herein by reference) or a collimator (e.g., an array of capillaries, as shown in FIGS. 9–10).

Figure 4:
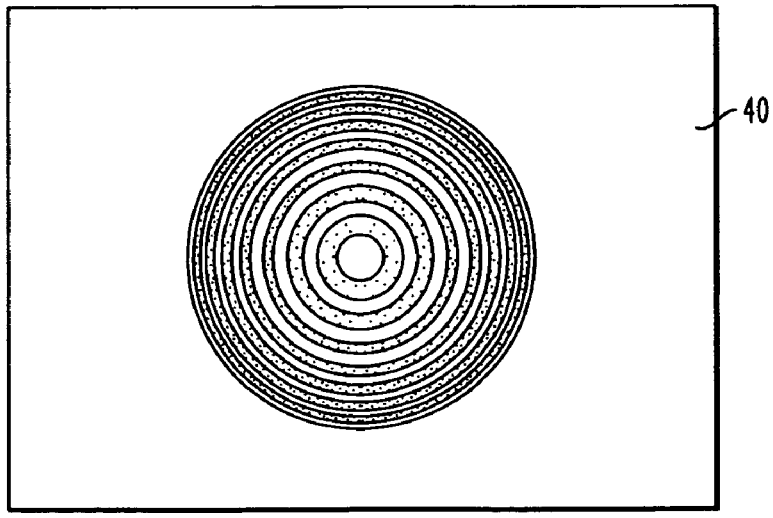
FIG. 4 shows a schematic, top view of an illustrative embodiment of a zone plate for use as a focusing element of the source of FIG. 1, in accordance with another embodiment of our invention.

As shown in FIG. 4, an x-ray filter comprises a zone plate 40, which includes a multiplicity of concentric, annular rings well known in the art. Illustratively, the zone plate may be a phase shift multi-focal plate of the type described by A. I. Cohen in U.S. Pat. No. 4,340,283 issued on Jul. 20, 1982, or it may be an amplitude-type Fresnel zone plate of the type described by Evans-Lutterodt et al. in U.S. Pat. No. 6,259,764 issued on Jul. 10, 2001 (The latter is preferred because it has lower optical loss than the former.) Both of these patents are incorporated herein by reference. In accordance with well-known principles the width and spacing of the annular rings are related to the wavelength of the x-rays to be focused and the focal length of the zone plate.

The fabrication of a Fresnel zone plate useful for our invention is described below in conjunction with FIGS. 5–10, which show two alternative techniques: a photolithographic patterning and etching process (FIGS. 5–7) and a photolithographic patterning and electroplating process (FIGS. 8–10).

Figure 5:
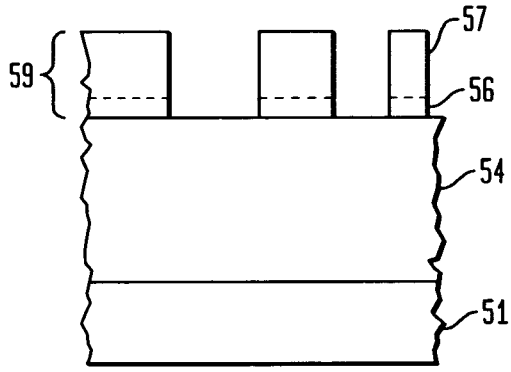
FIGS. 5–7 are schematic views depicting a sequence of processing steps for fabricating a zone plate of the type shown in FIG. 4, in accordance with another embodiment of our invention.

Turning first to the etching technique, we show in FIG. 5 a wafer or chip that includes a low atomic weight (Z), relatively thin membrane 51 (e.g., 100 nm of a material such as silicon nitride that does not significantly absorb x-rays) and a high-Z, relatively thick layer 54 (e.g., 3 μm of tungsten). A patterned masking layer 59 is formed on top of high-Z layer 54. The masking layer 59 may include a layer 57 of photoresist (PR) formed directly on top of high-Z layer 54, or it may optionally include a combination of a hard mask layer 56 formed on high-Z layer 54 and a PR layer 57 formed on top of the hard mask layer 56.

Figure 6:
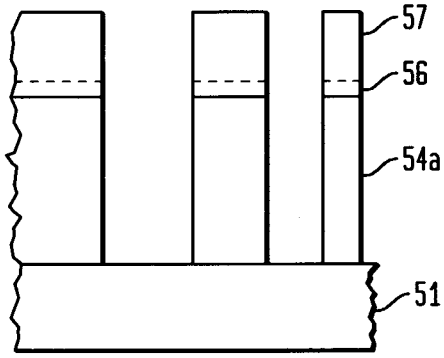
Figure 7:
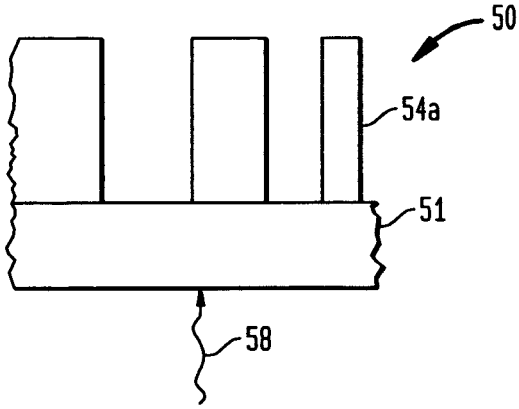

In either case, the wafer is then subjected to a well-known plasma etching process, which, as shown in FIG. 6, transfers the mask pattern into the high-Z layer 54. The masking layer 59 is removed, as shown in FIG. 7, leaving the patterned high-Z layer 54*a* on membrane 51. As described above, this pattern corresponds to a multiplicity of concentric, annular rings of varying width and spacing.

In contrast, in the electroplating technique, FIG. 8 shows a wafer or chip that includes a low-Z, relatively thin membrane 81 (e.g., silicon nitride), a conductive seed layer 82 (e.g., a metal such as gold), and a patterned masking layer 87 (e.g., PR) formed on seed layer 82. The wafer is immersed in a standard electroplating bath in order to deposit a metal (e.g., gold) in the openings of the patterned masking layer 87, as shown in FIG. 9. The wafer is then removed from the bath, and the masking layer is removed, leaving a patterned metal layer 84 on seed layer 82, as shown in FIG. 10. As above, the pattern corresponds to a multiplicity of concentric, annular rings of varying width and spacing.

In operation, as shown in FIGS. 7, 10 x-rays 58, 88 enter the zone plate 50, 80 through the bottom of membrane 51, 81 and are focused to multiple focal points in accordance with well-known Fresnel diffraction principles. In general, in medical applications multiple focal points present a problem: any x-rays that are not focused on diseased tissue region 30 (FIG. 1) could damage healthy tissue in neighboring regions. Accordingly, as shown in FIG. 1, the output face of x-ray apparatus 10 is provided with an addition spatial filter 20, which has an aperture 20.1 that blocks essentially all remaining x-rays except those that are focused on diseased tissue region 30.

Figure 11:
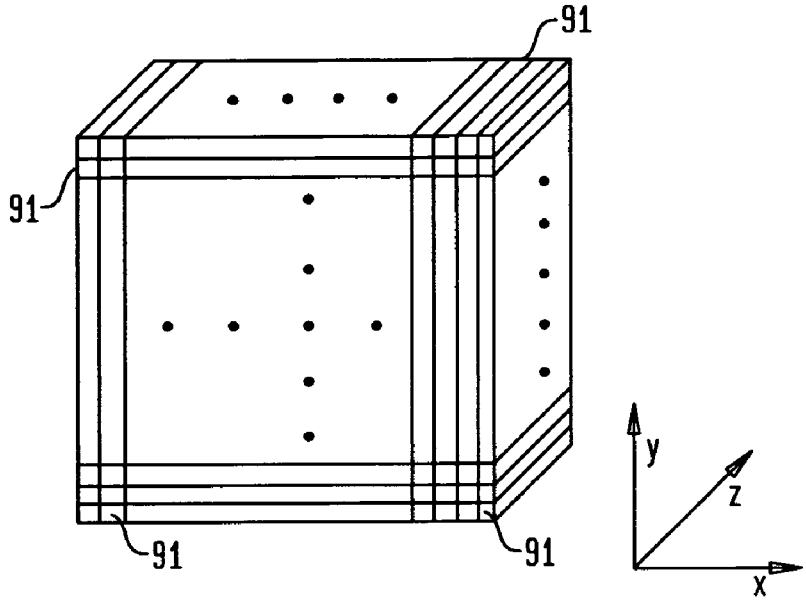
FIG. 11 is schematic, isometric view of an illustrative embodiment of a poly-capillary structure for use as a collimating element of the source of FIG. 1, in accordance with another embodiment of our invention.
Figure 12:
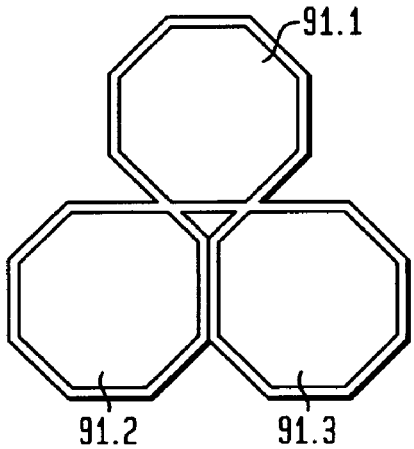
FIG. 12 is a schematic, end view of three adjacent capillaries of FIG. 10, in accordance with another embodiment of our invention.

Alternatively, a collimator comprises a multiplicity 90 of capillaries (also termed poly-capillaries), as shown in FIG. 11. The elongated axis of each capillary 91 extends in the z-direction, which is the general direction that x-rays propagate through the filter by grazing angle reflections with the interior capillary walls. The cross-section of each capillary 91 in the x-y plane is illustratively octagonal, with adjacent octagons 91.1, 91.2 and 91.3, for example, nested as depicted in FIG. 12. Capillaries of this type are readily fabricated in a Si substrate using well-known IC patterning and etching techniques. Illustratively, the overall width of the filter 90 may be of the order of a few millimeters, whereas the width of each capillary is of the order of 10 μm.

It is to be understood that the above-described arrangements are merely illustrative of the many possible specific embodiments that can be devised to represent application of the principles of the invention. Numerous and varied other arrangements can be devised in accordance with these principles by those skilled in the art without departing from the spirit and scope of the invention.

We claim:

1. A micro-miniature x-ray apparatus for steering focused x-rays in a selected direction, said apparatus comprising:

a first chip subassembly including a radiation source for generating both Bremsstrahlung photons and characteristic x-rays, a second chip subassembly including a filter for preferentially transmitting the characteristic x-rays but blocking the Bremsstrahlung photons, a third chip subassembly including a movable element for focusing or collimating the transmitted characteristic x-rays into a beam and means for controlling the position of the movable element.

2. The apparatus of claim 1, wherein said movable element comprises a Fresnel device for focusing said characteristic x-rays.

3. The apparatus of claim 1, wherein said movable element comprises a multiplicity of capillaries for collimating said characteristic x-rays.

4. The apparatus of claim 1, wherein said x-ray source comprises an array of field emitters for generating electrons, a target responsive to said electrons for generating said x-rays, and an acceleration electrode for accelerating said electrons as they move from said emitters to said target.

5. The apparatus of claim 4, wherein said acceleration electrode is segmented into a multiplicity of separate electrodes, and further including means for applying voltage to selected ones of the segmented electrodes.

6. The apparatus of claim 4, further including an electron lens for focusing said electrons onto said target.

7. The apparatus of claim 1, wherein said filter includes a spatial filter for blocking said Bremsstrahlung photons.

8. The apparatus of claim 7, wherein said spatial filter includes an aperture for transmitting said characteristic x-rays.

9. The apparatus of claim 7, wherein said characteristic x-rays include x-rays at different frequency bands and wherein said filter includes a sprctral filter for blocking x-rays at at least one of said frequency bands.

10. The apparatus of claim 1, wherein said controller comprises a MEMS controller including a support structure including a base and having an opening in which said movable element is suspended, resilient means for coupling said element to said structure, and a multiplicity of first control electrodes located on said base, said element serving as a second control electrode, so that voltage applied between said second electrode and selected ones of said first electrodes controls the movement of said element.

11. The apparatus of claim 10, wherein said filter includes a spatial filter for blocking said Bremsstrahlung photons, said spatial filter comprising an annular member that surrounds an aperture for blocking those Bremsstrahlung photons whose propagation direction is outside a preselected angular cone, and said annular member forming said base on which said first control electrodes are located.

12. The apparatus of claim 1 further including a catheter, said apparatus being mounted on the end of said catheter.

13. A micro-miniature x-ray apparatus for steering focused x-rays in a selected direction, said apparatus comprising:

a radiation source for generating both Bremsstrahlung photons and characteristic x-rays, a filter for preferentially transmitting the characteristic x-rays but blocking the Bremsstrahlung photons, a movable MEMS element for focusing or collimating the transmitted characteristic x-rays into a beam and means for controlling the position of the movable MEMS element.

* * * * *